US012593906B2

(12) United States Patent
Weintraub

(10) Patent No.: US 12,593,906 B2
(45) Date of Patent: Apr. 7, 2026

(54) CAPS FOR COSMETIC IMPLEMENTS

(71) Applicant: Brandi Theodette Weintraub, Albany, CA (US)

(72) Inventor: Brandi Theodette Weintraub, Albany, CA (US)

( * ) Notice: Subject to any disclaimer, the term of this patent is extended or adjusted under 35 U.S.C. 154(b) by 70 days.

(21) Appl. No.: 17/307,871

(22) Filed: May 4, 2021

(65) Prior Publication Data

US 2021/0337952 A1 Nov. 4, 2021

Related U.S. Application Data

(60) Provisional application No. 63/019,904, filed on May 4, 2020.

(51) Int. Cl.
*A45D 40/20* (2006.01)
*B65D 41/22* (2006.01)
(Continued)

(52) U.S. Cl.
CPC ..... *A45D 40/20* (2013.01); *B65D 41/22* (2013.01); *B65D 51/005* (2013.01); *B65D 51/24* (2013.01);
(Continued)

(58) Field of Classification Search
CPC ..... B43K 23/08; B43K 23/10; B43K 23/12; B43K 23/126; B43K 23/122;
(Continued)

(56) References Cited

U.S. PATENT DOCUMENTS 634,013 A * 10/1899 Mitchell ..... B43K 23/12 403/345
2,312,069 A * 2/1943 Baumgartner ..... B43K 23/10 401/98
(Continued)

FOREIGN PATENT DOCUMENTS

EP 0400272 A1 * 12/1990
GB 782159 A * 9/1957
(Continued)

OTHER PUBLICATIONS

JP_2012030822_A_translation.pdf (Year: 2012).*

*Primary Examiner* — Allan D Stevens
(74) *Attorney, Agent, or Firm* — PERKINS COIE LLP; Andrew T. Pettit; Katlyn Stockslager

(57) ABSTRACT

A cap can be configured to engage with cosmetic application devices (also referred to as "applicators" or "cosmetic implements") of various sizes. The cap may include a rigid housing and a flexible body within the rigid housing comprised of elastic material. The flexible body includes a cavity that extends from an opening in the proximal end portion toward the distal end portion of the cap and varies in diameter along its length. The cap may receive an application segment of an applicator through the opening, and the inner surface of the cap can apply pressure to a surface of the applicator to form a seal between the applicator and the cap. The seal between the applicator and the cap protects the application segment from dust and debris and prevents fluid in the applicator segment from drying or hardening.

12 Claims, 16 Drawing Sheets

(51) Int. Cl.
*B65D 51/00* (2006.01)
*B65D 51/24* (2006.01)
*B65D 55/16* (2006.01)
*A45D 40/00* (2006.01)

(52) U.S. Cl.
CPC ..... *B65D 55/16* (2013.01); *A45D 2040/0018* (2013.01); *A45D 2040/201* (2013.01); *A45D 2200/051* (2013.01); *A45D 2200/1072* (2013.01); *B65D 2251/08* (2013.01)

(58) Field of Classification Search
CPC .. B43K 23/124; B43K 23/128; B43K 27/003; A45D 2040/201; A45D 40/20; A45D 2040/202; A45D 2040/207; A45D 40/205; B65D 41/005; B65D 41/023; B65D 41/165; B65D 41/185; A46B 11/0079; A46B 11/0086
USPC ..... 132/317, 318
See application file for complete search history.

(56) References Cited

U.S. PATENT DOCUMENTS 2,438,231 A * 3/1948 Schultz ..... B43K 23/126 211/DIG. 1
3,609,052 A * 9/1971 Airosus ..... B43K 8/022 401/199
4,573,818 A * 3/1986 Kodera ..... B43K 25/022 401/35
5,114,258 A * 5/1992 Yasunaga ..... B43K 23/124 401/202
5,462,379 A * 10/1995 Masumoto ..... B43K 23/12 401/214
5,911,534 A * 6/1999 Toyama ..... B43K 23/12 401/6
5,931,593 A * 8/1999 Roder ..... B43K 23/08 401/98
5,941,254 A * 8/1999 Heler ..... A45D 40/18 132/297
5,957,608 A * 9/1999 Matsumoto ..... B43K 23/12 401/245
6,200,046 B1 * 3/2001 Rylander ..... B43K 23/08 401/243
6,450,179 B2 * 9/2002 Bengis ..... A63H 33/28 132/297
6,779,937 B1 * 8/2004 Lombardi ..... A45D 40/205 401/6
7,131,785 B1 * 11/2006 Mansouri ..... B43K 29/00 401/243
2004/0161288 A1 * 8/2004 Tsai ..... B43K 23/126 362/118
2005/0053411 A1 * 3/2005 Maldonado ..... B43K 23/10 401/52
2006/0027518 A1 * 2/2006 Keda ..... B43K 25/022 215/254
2008/0244917 A1 * 10/2008 Eisen ..... B43K 23/10 30/457
2010/0266326 A1 * 10/2010 Chuang ..... B43K 23/124 401/98
2011/0135375 A1 * 6/2011 Lattanzi ..... A45D 40/24 401/17
2018/0361782 A1 * 12/2018 Lahey ..... B43K 23/08

FOREIGN PATENT DOCUMENTS

GB 1051115 A * 12/1966
JP 3513099 B2 * 3/2004 ..... A45D 40/205
JP 2012030822 A * 2/2012

* cited by examiner

CAPS FOR COSMETIC IMPLEMENTS

CROSS-REFERENCE TO RELATED APPLICATIONS

This application claims the benefit of U.S. Provisional Patent Application No. 63/019,904, titled "Caps for Cosmetic Implements" and filed on May 4, 2020, which is incorporated by reference herein in its entirety.

TECHNICAL FIELD

Various embodiments concern caps designed to engage cosmetic implements of different sizes to inhibit the exposure of any materials stored therein.

BACKGROUND

Cosmetic implements (also referred to as "cosmetic utensils" or "cosmetic tools") are items that can be used to facilitate the application or removal of cosmetics. One example of a cosmetic implement is an application device (also referred to as an "application instrument" or "applicator") that can be used to dispense or apply a material onto a surface. Examples of such materials include non-malleable solid materials (e.g., graphite), malleable solid materials (e.g., pigments and wax), and liquids (e.g., oil and gels). For example, an eyeliner pencil may include a solid powder- or wax-based core that leaves a trail when applied to the skin. As another example, lipstick may be installed within a hollow cylindrical tube such that the lipstick can be easily applied by drawing the tube across the lips. Other examples of applicators include tattoo pens and cosmetic products, such as brushes, sponges, and the like.

Some applicators include (i) a handling segment (also referred to as a "handling portion" or "handle segment") designed for grasping, (ii) a store of material to be dispensed, and (iii) an application segment (also referred to as an "application portion") for dispensing the material in the store. One example of such an applicator is an eyeliner pencil, where the powder- or wax-based core represents the store of material, the surrounding wood represents the handling segment, and the sharpened end represents the application segment. Other applicators only include (i) a handling segment designed for grasping and (ii) an application segment for applying, removing, or altering material when in contact with another surface. One example of such an applicator is a makeup brush, where the handle represents the handling segment while the bristles represent the application segment.

Prolonged exposure of the application segment can cause several issues. First, prolonged exposure may cause any material(s) stored in an applicator to dry, harden, or otherwise become unusable. For instance, the liquid housed in a liquid eye liner may dry if exposed to air for an extended duration of time. This may cause the applicator to be unable to properly dispense the material(s) as desired. Second, prolonged exposure may harm the quality of the application segment. In some instances, the harm is physical (e.g., due to jostling with other items in a cosmetic kit). For example, the tip of an eyeliner pencil could break if impacted with sufficient force, or the bristles of a makeup brush may be harmed if left exposed. In other instances, the harm is caused by exposure to ambient conditions (e.g., air, water, etc.) that allow for external particles to come into contact with the application segment, which may lower cleanliness and overall user experience.

Figure 1:
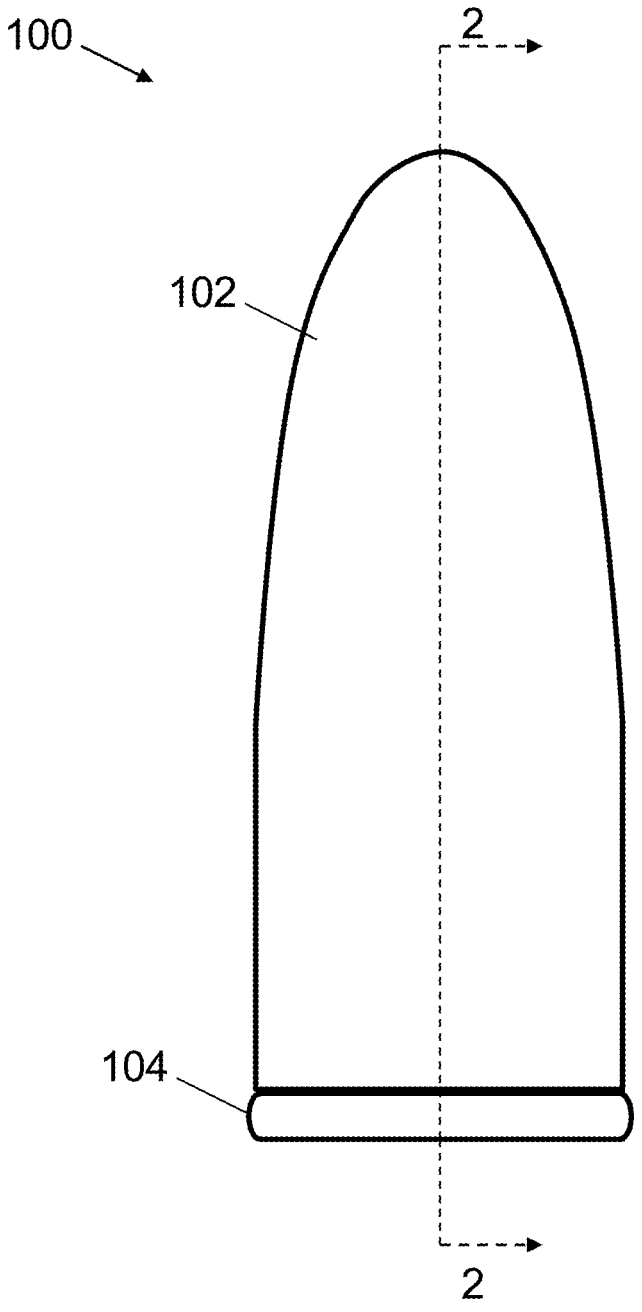
FIG. 1 illustrates an example cap.

Various features of the technologies described herein will become more apparent to those skilled in the art from a study of the Detailed Description in conjunction with the drawings. Embodiments are illustrated by way of example and not limitation in the drawings, in which like references may indicate similar elements. While the drawings depict various embodiments for the purpose of illustration, those skilled in the art will recognize that alternative embodiments may be employed without departing from the principles of the technologies. Accordingly, while specific embodiments are shown in the drawings, the technology is amenable to various modifications.

DETAILED DESCRIPTION

Applicators may be designed to dispense, spread, or apply a material (e.g., fluid, liquid, wax, oil) onto a desired surface. As an example, a liquid eye liner may come with a brush that can be used apply the liquid eye liner as desired. Other examples of applicators include lipstick, lip balm, cosmetic pencils, cosmetic brushes, cosmetic sponges, tattoo pens, etc. Regardless of its form, each applicator includes an application segment that comes into contact with the surface on which the material is to be dispensed, spread, or applied.

However, when exposed to air for a prolonged duration of time, the material included in the applicators may dry. For example, a portion of liquid in a liquid eyeliner applicator may dry if exposed to air. Further, if an application material dries or hardens, an applicator may be unable to properly dispense the material as desired because the application material blocks or inhibits the dispensing from the applicator. Further, an applicator exposed to outside conditions (air, water, etc.) may allow for external particles (e.g., dirt, dust) to come into contact with the material, which may lower cleanliness and overall user experience when using the applicator.

Accordingly, many applicators include caps that are specifically designed to enclose an applicator segment of one such applicator. Some caps may include an applicator, such as a brush attached to the cap. The cap may prevent a single-use device from having the applicator and the material exposed to outside conditions.

However, if a specifically-designed cap is lost or destroyed, the applicator may be exposed to conditions that lower the efficacy of the applicator. In this event, the material contained in the applicator may have to be transferred to a new container. In some cases, the application device may be rendered useless and may have to be discarded and replaced with an entirely new applicator. This may be inefficient use of resources when the applicator device is otherwise in working condition. For example, lip balm is often packaged in a tube with a small plastic cap which is easily dropped. A user may lose the cap or not want to continue using the dropped cap for sanitary reasons. Without the cap, the lip balm may then dry out, rendering it unsuitable for moistening dry lips.

The present embodiments relate to a flexible, all-purpose cap that is able to removably engage applicators of various sizes. The cap may include a cavity configured to surround the application segment of a given applicator and then form a seal between the cap and the application segment. The cap may enclose the application segment so as to prevent external objects (e.g., dirt, dust, and hair) from contacting the application segment. Additionally, the cap may prevent materials (e.g., liquid and solid cosmetics) stored in the applicator from drying, hardening, or otherwise becoming unusable due to exposure to outside conditions. The cap includes a flexible insert that can accommodate different sizes and shapes, allowing it to be used with a variety of different applicators.

Overview

FIG. 1 illustrates an example cap 100. As shown in FIG. 1, the cap 100 (also referred to as a "cover") may include a rigid housing 102 and a flexible body 104 (also referred to as a "tubular body"). As shown in FIG. 1, the flexible body 104 is substantially within the rigid housing 102, with a portion of the flexible body 104 exposed to form a rim along the rigid housing 102. In some embodiments, the flexible body may be entirely within the rigid housing. In FIG. 1, the distal portion 108 is within the rigid housing 102. The rigid housing 102 may be closed and rounded so as to form a rounded cone. The rigid housing 102 may protect the flexible body 104 from external damage, such as scratches or impacts. The rigid housing 102 may be comprised of plastic, wood, bamboo, metal, glass, or other materials. The rigid housing 102 may be textured or smooth. The flexible body 104 may be removable from rigid housing 102.

The shape of the rigid housing 102 may form a bullet shape with a circular horizontal cross-section, as shown in FIG. 1. In some embodiments, the rigid housing 102 can be other shapes, such as having a quadrilateral (e.g., square, diamond, etc.), ovoid, triangular, pentagonal, hexagonal, octagonal, or star-shaped cross-section. For example, a shape with a flat edge may prevent the cap 100 from rolling when placed on a surface.

Figure 2:
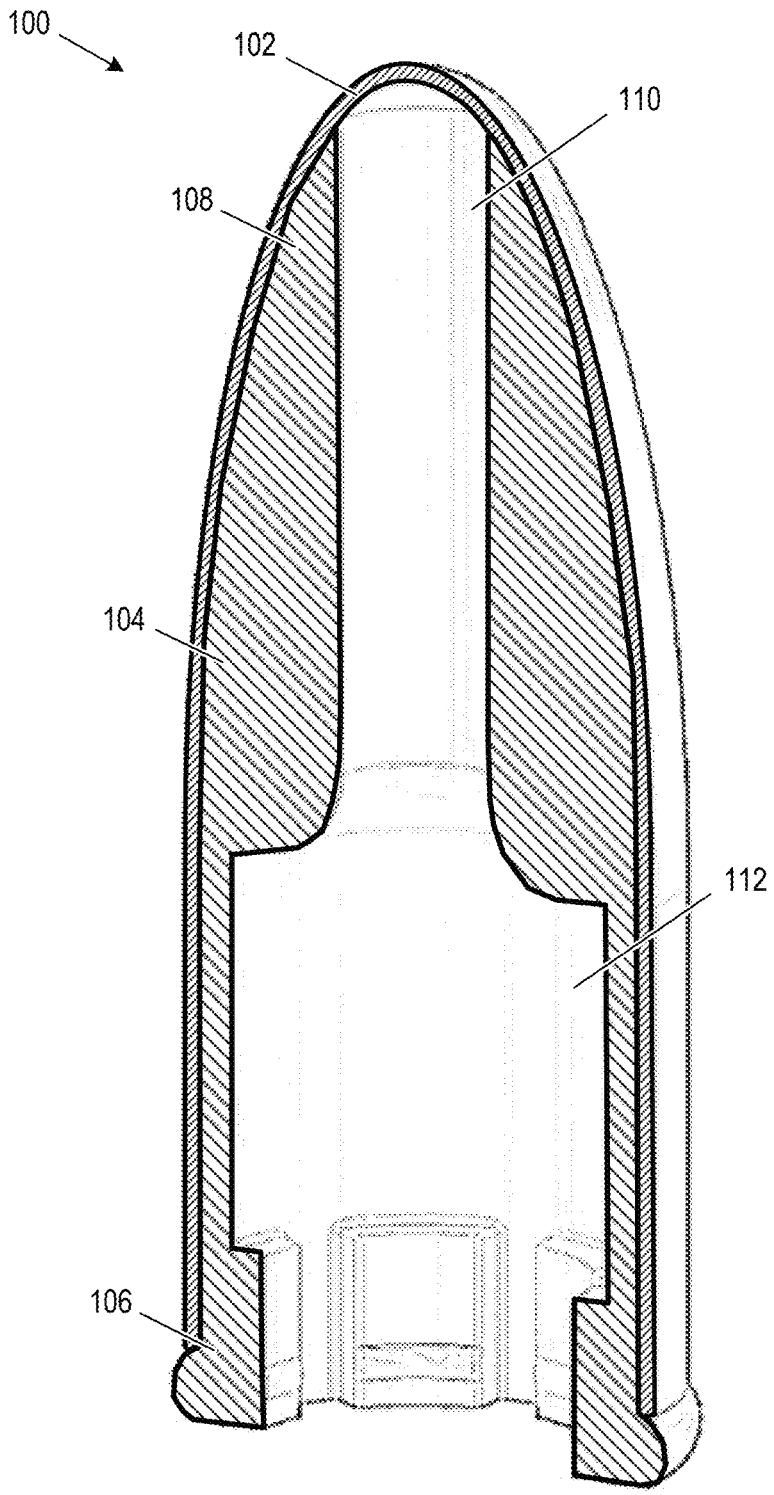
FIG. 2 illustrates a vertical cross-section of an example cap taken along line 2-2 of FIG. 1.

FIG. 2 illustrates a vertical cross-section of cap 100 taken along line 2-2 of FIG. 1, in accordance with various embodiments. The tubular body 104 has a first portion 106 (also referred to as the "proximal portion") and a second portion 108 (also referred to as the "distal portion") opposing the first portion 106. As shown in FIG. 2, the proximal portion 106 of the cap 100 may include a proximal opening that forms an opening of a cavity through which a cosmetic implement can be inserted. The distal portion 108 has an inner surface which defines a cavity 110 which may store an application segment of a cosmetic implement. The tubular body 104 may include a channel 112 between the proximal portion 106 and the distal portion 108 defined by an inner surface of the tubular body 104. The channel 112 may store an application segment of a cosmetic implement.

In some embodiments, the channel 112 may have a diameter greater than the diameter of the cavity 110, which allows the channel 112 to accommodate larger application segments than the cavity 110. For example, the cavity 110 may be used to store a pencil, while the channel 112 may store wider brushes.

The tubular body 104 may be comprised of a deformable material (also referred to as a "flexible material" or an "elastic material"), such as rubber, silicone, or other elastomers. The deformable material may deform under pressure, such as from an application segment or handle segment of an inserted cosmetic implement, and regain its original shape when the pressure is removed. The deformation may allow the tubular body 104 to accommodate a variety of shapes and sizes of cosmetic implements. For example, tubular body 104 may deform so that the cavity 110 can hold cylindrical, square, and hexagonal pencils even though the shape of the cavity 110 may be cylindrical when no pressure is applied. In some embodiments, the deformable material includes one or more additives that provide antimicrobial or antibacterial properties. For example, the deformable material may contain embedded copper, zinc, silver, cobalt, or nickel nanoparticles so as to inhibit the growth or development of unwanted contaminants, thereby acting as a disinfectant. Some of these additives (e.g., nickel) may be used in low amounts or particular circumstances due to the higher likelihood of allergic reactions to those nanoparticles.

The proximal portion 106 may include a plurality of protrusions 111 configured to grip a handle segment of the inserted cosmetic implement. For example, the protrusions 111 can be made of the same flexible material as the rest of the tubular body 104, which may allow the protrusions 111 to grip a range of sizes and shapes. The protrusions 111 are shown in FIG. 2 as having rectangular shape, but may be any suitable shape for gripping a handle of a cosmetic implement, such as dome shaped, ridged, etc.

The diameter of the proximal opening of proximal portion 106 may be correlated with a diameter of a handle segment of a cosmetic implement. For example, the diameter of the proximal opening may be greater than the diameter of the cavity 110 and less than the diameter of the channel 112. This configuration may be suitable for storing an application segment that is wider than the handle segment in the wider channel 112, such as a brush. This configuration may also be suitable for storing an application segment that is narrower than the handle segment in the narrower cavity 110, such as a sharpened pencil.

Figure 3:
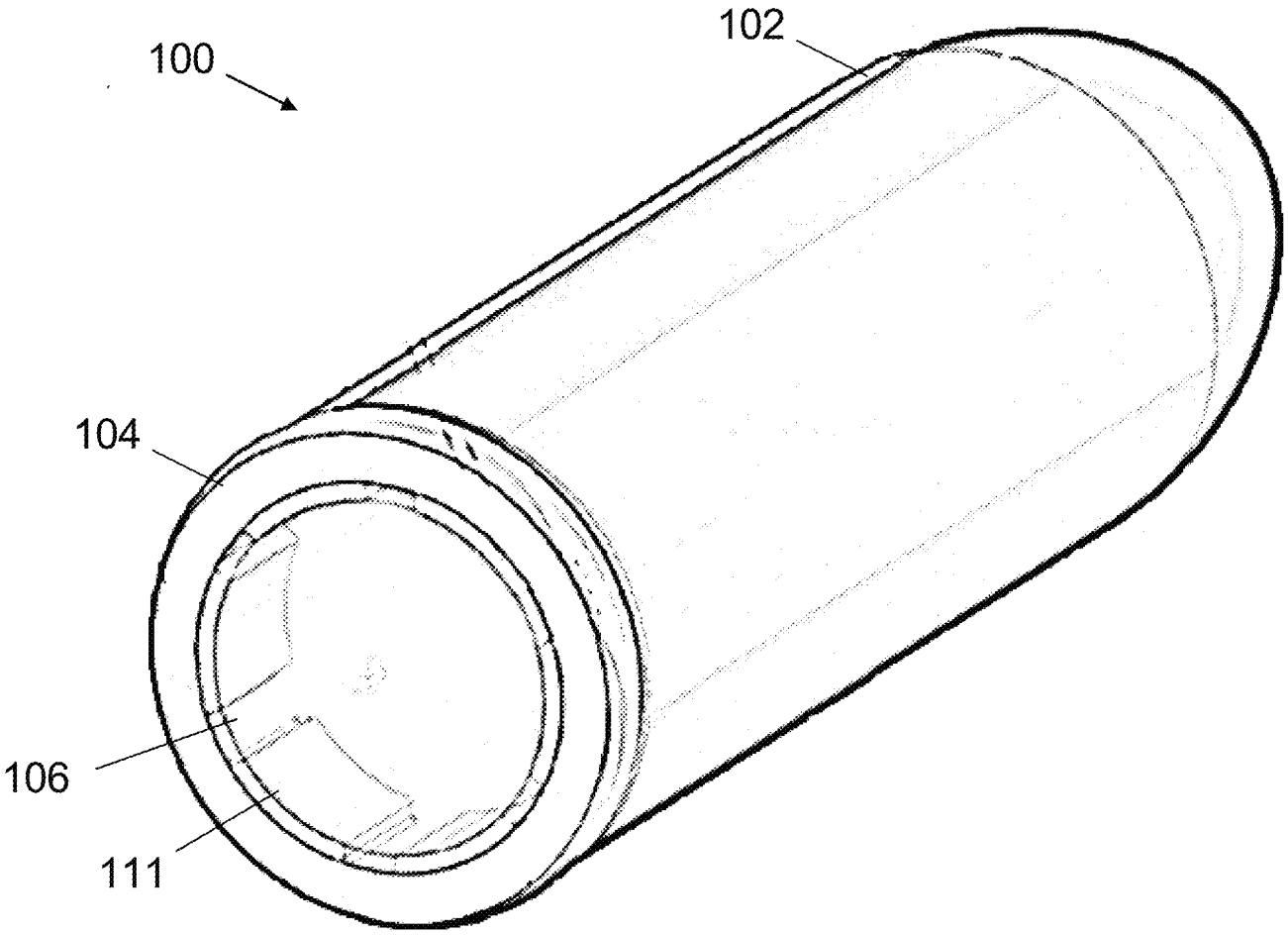
FIG. 3 illustrates a perspective view of a cavity formed in an example cap.

FIG. 3 illustrates a perspective view of a cavity formed in an example cap. As shown in FIG. 3, the proximal portion 106 of the flexible body 104 may include a proximal opening and a plurality of protrusions 111. FIG. 3 shows an example cap with six protrusions 111. In some embodiments, the proximal portion 106 may have other numbers of protrusions, such as 3, 4, 5, etc. The diameter of the proximal opening may correlate to a diameter/width of a handle segment of a cosmetic implement. For example, the proximal opening may be about 8 millimeter (mm), similar to a diameter of a pencil. In some embodiments, the proximal opening may be larger than 8 mm, such as to hold a handle segment of a lipstick or kabuki brush. In some embodiments, the proximal opening may be smaller than 8 mm.

Figure 4:
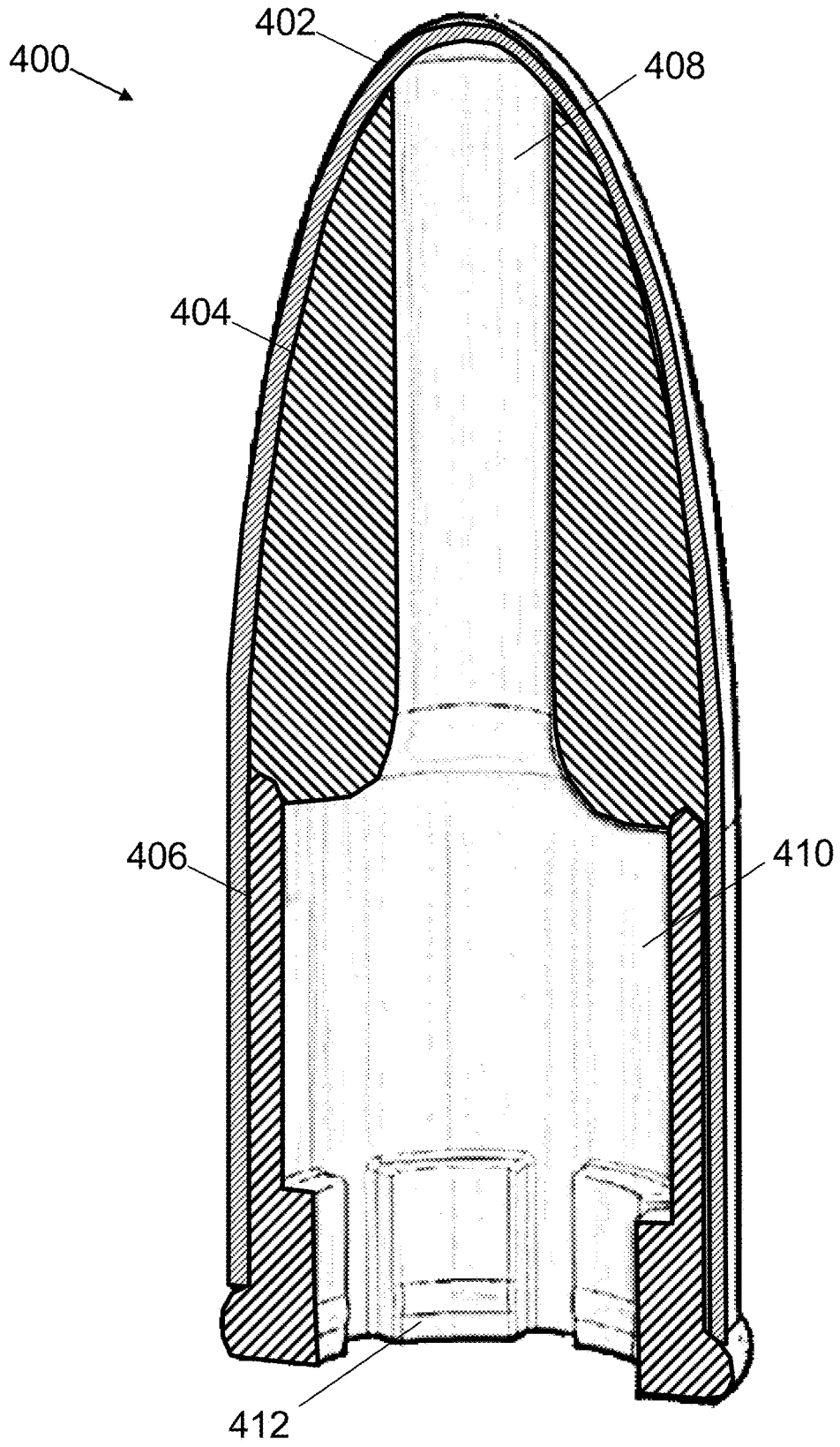
FIG. 4 illustrates a vertical cross-section of an example cap with multiple inserts taken along line 4-4 of FIG. 6.

FIG. 4 illustrates a vertical cross-section of an example cap 400 with multiple inserts. Cap 400 can include a rigid housing 402, a first flexible insert 404 within a distal portion of the rigid housing 402, and a second flexible insert 406 substantially within a proximal portion of the rigid housing 402. The rigid housing 402 can be similar to rigid housing 102 in FIGS. 1-3. The first and second flexible inserts 404 and 406 can be made of a similar deformable material as flexible body 104 in FIGS. 1-3. The first and second flexible inserts 404 and 406 may be comprised of the same deformable materials or may be comprised of different deformable materials. For example, the first flexible insert 404 may be comprised of a softer silicone to store more delicate application segments, while the second flexible insert 406 may be comprised of a harder rubber. In some embodiments, the first and second flexible inserts 404 and 406 may be removable from the rigid housing 402.

The first flexible insert 404 has an inner surface that defines a cavity 408, similar to cavity 110 in FIG. 2. The second flexible insert 406 has an inner surface that defines a channel 410, similar to channel 112 of FIG. 2. The second flexible insert 406 may have a proximal opening with a plurality of protrusions 412 along the channel 410, similar to protrusions 111 of FIGS. 2-3. The plurality of protrusions 412 may grip a handle segment of a cosmetic implement, while the channel 410 or the cavity 408 store an applicator of the cosmetic implement. The diameter or width of cavity 408 may be less than the diameter or width of channel 410. In some embodiments, a user may mix and match first and second flexible inserts 404 and 406 with varying diameters to accommodate cosmetic implements with different proportions.

Figure 5:
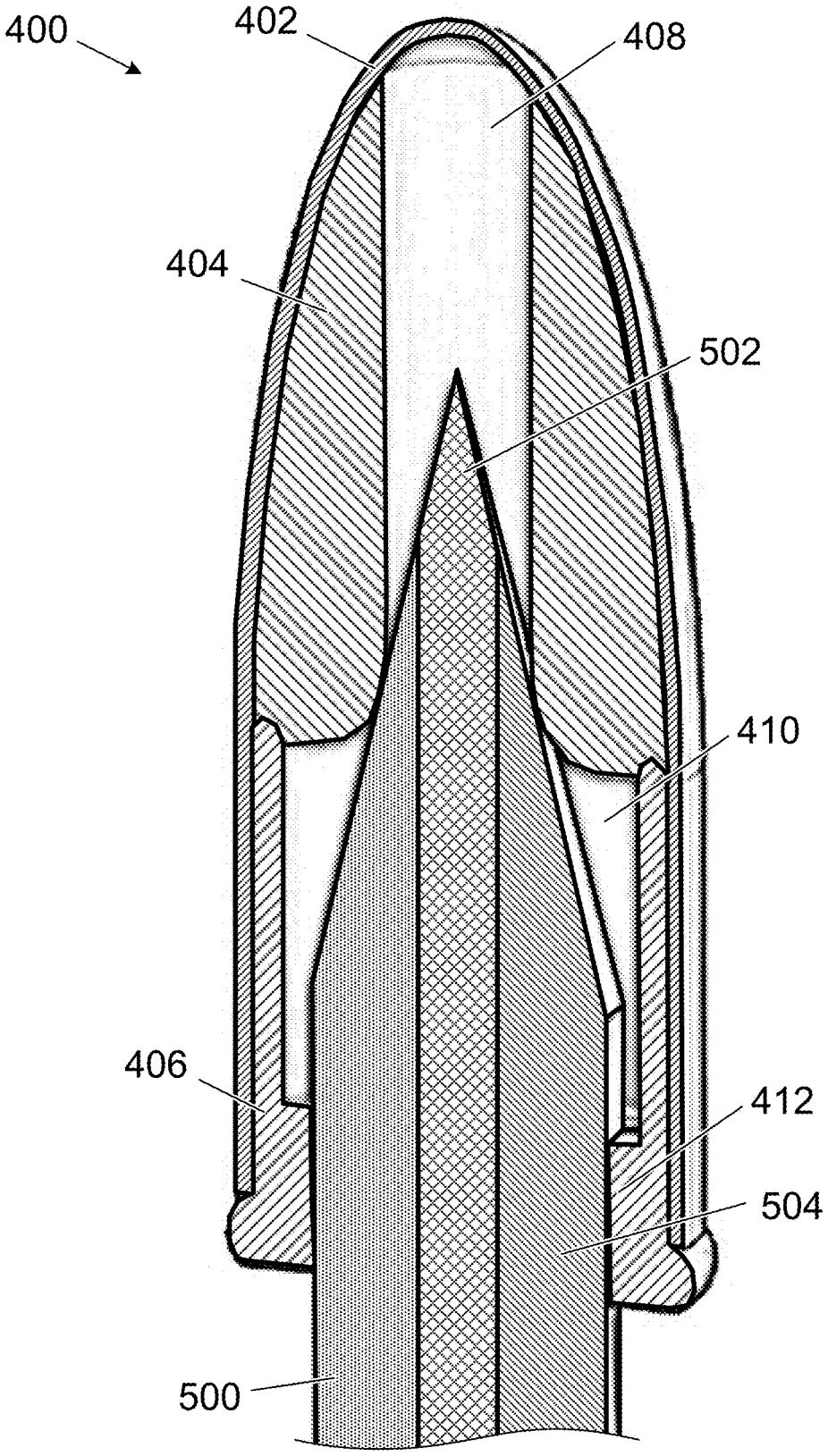
FIG. 5 illustrates a vertical cross-section of an example cap taken along line 4-4 of FIG. 6 with an inserted cosmetic implement.

FIG. 5 illustrates a vertical cross-section of an example cap 400 with an inserted cosmetic implement 500. An applicator segment 502 of cosmetic implement 500 may be disposed within the cavity 408 defined in first insert 404. For instance, a user may insert the applicator segment 502 through the proximal opening of the first insert 404 and into the cavity 408 of the second insert 406. The protrusions 412 may apply pressure to a handle segment 504 of the cosmetic implement and form a seal between the cap 400 and cosmetic implement 500. For example, as shown in FIG. 5, the applicator segment 502 of cosmetic implement 500 is a sharpened point which is disposed within cavity 408, while the handle segment 504 is gripped by the protrusions 412. In another example, an applicator segment 502 wider than the cavity 408, such as a brush head, may be disposed within channel 410 instead of cavity 408. Although FIG. 5 shows a cap 400 with multiple inserts 404 and 406, a cosmetic implement 500 can be similarly inserted into a cap with a single flexible body, such as cap 100 of FIGS. 1-3.

Figure 6:
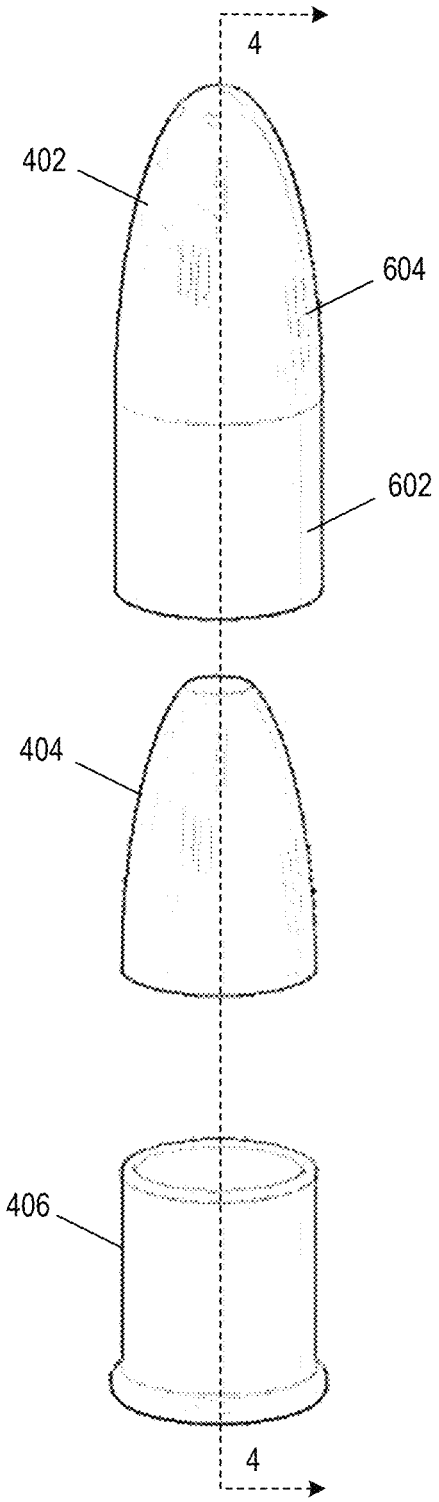
FIG. 6 illustrates an exploded view of an example cap with multiple inserts.

FIG. 6 illustrates an exploded view of an example cap 400 with multiple inserts. Cap 400 can include a rigid housing 402, a first flexible insert 404 configured to be disposed within a distal portion of the rigid housing 402, and a second flexible insert 406 configured to be disposed substantially within a proximal portion of the rigid housing 402. The first and second flexible inserts 404 and 406 may be removable from the rigid housing 402. The cap 400 may be assembled by providing rigid housing 402, inserting the first flexible insert 404 into the rigid housing 402, and inserting the second flexible insert 406 into the rigid housing.

At a high level, the caps described herein are intended to replace those that accompany applicators when purchased. Accordingly, care may also be taken to ensure that the caps themselves cannot be readily lost. For example, the rigid housing 402 or second flexible insert 406 may have an attachment mechanism secured thereto near the proximal end that allows the cap 400 to be securely affixed to the applicator. For example, a mechanical gasket (also referred to as an "O-ring") may be located at one end of a cable while the other end of the cable is connected to the rigid housing 402 or second flexible insert 406. The mechanical gasket may be in the form of an extruded annulus or torus. Moreover, the mechanical gasket may be sized such that it can slidably engage the handling segment of an applicator. When the mechanical gasket is installed on the handling segment of the applicator, the cap 400 can be removed from the application segment without concern about losing the cap 400.

Embodiments may also be designed with usability in mind. As can be seen in FIG. 6, the rigid housing may be comprised of two sections, namely, a first section 602 and a second section 604. The first section 602 may have the form of a hollow cylinder while the second section 604 may have the form of a rounded cone. The second section 604 may be partially or fully detachable from the first section 602 so as to allow a user to more readily access the application segment of an application that is stored in the cap 400.

For example, the first and second sections 602, 604 may threadably engage one another so that the second section 604 can be easily detached from, and then reattached to, the first section 602. When the second section 604 is removed from the first section 602, the application segment of the applicator may be accessible since the first flexible insert 404 may be removed as well. Accordingly, the applicator could be used without removing the first section 602 of the rigid housing 402 (or the second flexible insert 406 installed within the first section 602 of the rigid housing 402). Additionally or alternatively, the first and second sections 602, 604 could mechanical features such as clips, nests, and the like. For instance, the second section 604 may include one or more structural features referred to as "feet" that can "nest" within corresponding cavities in the first section 602. Once the feet are located within the corresponding cavities, a user may be able to rotate the second section 604 in order to cause lateral movement of the feet. Each cavity may have an "L" shape or inverted "T" shape that allows limited lateral movement of the feet, but then prevents upward movement of the feet (and thus removal of the second section 604) following lateral movement.

As another example, the first and second sections 602, 604 may include one or more magnets that are arranged in a complementary manner. Thus, a user may be able to remove the second section 604 of the rigid housing 402 by tugging with enough force to overcome the magnetic force between the magnet(s) in the second section 604 and the magnet(s) in the first section 602.

As another example, the first and second sections 602, 604 may be connected to one another via a hinge. At a high level, the hinge permits the second section 604 to be rotated with respect to the first section 602 while the first section 602 is installed along the handling segment of an applicator. Those skilled in the art will recognize that because the application segment of the application is maintained in the second section 604 of the rigid housing 402, a fixed design (i.e., where the first and second sections 602, 604 are both directly connected to the hinge) may be impractical. Simply put, the length of the application segment of the applicator may prevent rotation of the second section 604 in some instances. Accordingly, the hinge may be connected to a vertical mount that slidably engages the first section 602. Assume, for example, that a user is interested in exposing the application segment of an application without removing the cap 400 entirely. In such a scenario, the user may tug on the second section 604 of the rigid housing. This application of force may cause the second section 604 to move upward with respect to the first section 602 that remains in place. As mentioned above, this vertical movement may be facilitated by a vertical mount that is installed along the inner or outer surface of the first section 602. Once the second section 604 has reached a sufficient height (e.g., 5 mm above the first section 602), the user may rotate the second section 604 using a hinge that is interconnected between the second section 604 and vertical mount.

Figure 7:
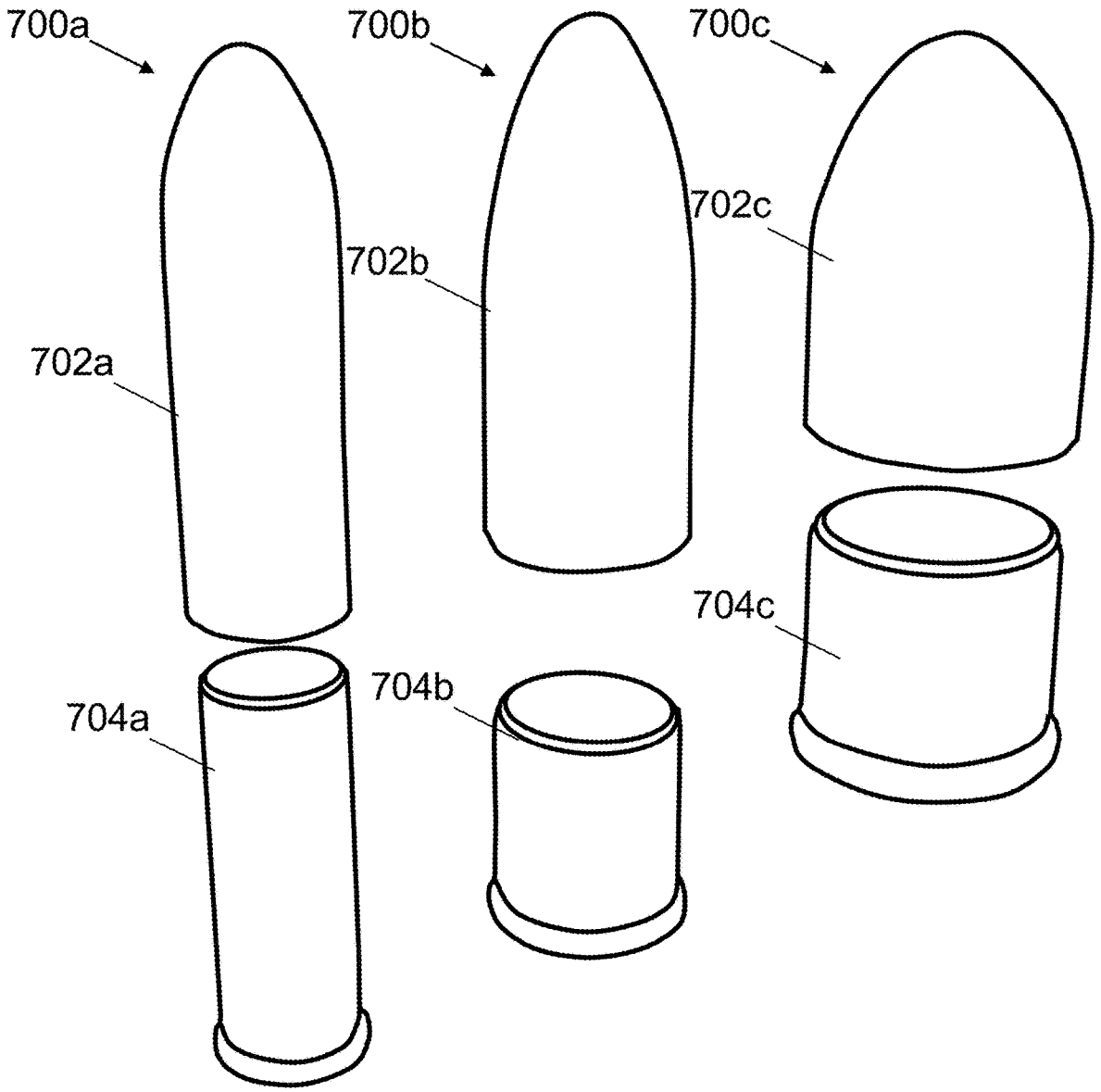
FIG. 7 illustrates an exploded view of example caps of different sizes.

FIG. 7 illustrates an exploded view of example caps 700*a*, 700*b*, and 700*c* of different sizes. Caps 700*a-c* each have a rigid housing 702*a-c* respectively. Caps 700*a-c* each have at least a flexible insert 704*a-c* respectively. As shown in FIG. 7, the flexible inserts 704*a-c* may be similar to second flexible insert 406 in FIGS. 4-6. For example, flexible inserts 704*a-c* can have a plurality of protrusions that apply pressure to a handle segment of an inserted cosmetic implement. In some embodiments, caps 700*a-c* can have multiple flexible inserts, similar to first and second flexible inserts 404 and 406 of cap 400 in FIGS. 4-6. In some embodiments, caps 700*a-c* can have a single flexible body, similar to flexible body 104 of cap 100 in FIGS. 1-3.

Even though flexible inserts 704*a-c* may deform when pressure is applied to allow caps 700*a-c* to store applicators of different shapes and sizes, some cosmetic implements may still be too large or too small for a given cap, even accounting for the deformation. Therefore, caps 700*a-c* can have different sizes or shapes to accommodate especially large or small cosmetic implements. For example, cap 700*a* is narrower and taller than cap 700*c*, which may be better suited for narrow/long cosmetic implements, such as pencils.

In some embodiments, a cap may have a proximal opening with a diameter of about 8-10 mm and a length of about 40 mm. In some embodiments, a cap may have a diameter of about 15 mm and a length of about 40 mm. In some embodiments, a cap may have a diameter of about 20 mm and a length of about 35 mm. In general, the diameter of a cap can vary from about 5 mm to about 20 mm. In general, the length of a cap can vary from about 20 mm to about 100 mm.

In some embodiments, the rigid housings 702*a-c* may house a magnet in a distal portion of the rigid housings 702*a-c*. This magnet may be used to magnetically attach the caps 700*a-c* to metal or other magnetic surfaces. This may prevent a user from accidentally misplacing the cap. The magnet may be used with a magnetic organizing apparatus, such as a tray with magnetic slots. For example, such a magnetic tray may allow the caps 700*a-c* to hang vertically from the tray by magnetic force.

In some embodiments, the rigid housings 702*a-c* may house a pencil sharpener. For instance, a pencil sharpener can be attached or integrated into an inner surface of the rigid housings 702*a-c*. The caps 700*a-c* may thus be used to store a pencil as well as sharpen the pencil. The pencil sharpener may be accessed by removing any flexible inserts, such as flexible inserts 704*a-c*. In some embodiments, the pencil sharpener may be accessed while the flexible inserts 704*a-c* are within the rigid housings 702*a-c* respectively. Tools such as pencil sharpeners may be also included in the multi-part design discussed above with reference to FIGS. 1-6. For example, a pencil sharpener that is installed along the inner surface of the rigid housing 102 shown in FIG. 2 may be accessed by removing the flexible body 104. As another example, a pencil sharpener that is installed along the inner surface of the rigid housing 402 shown in FIG. 4 may be accessed by removing the second flexible insert 406.

Figure 8:
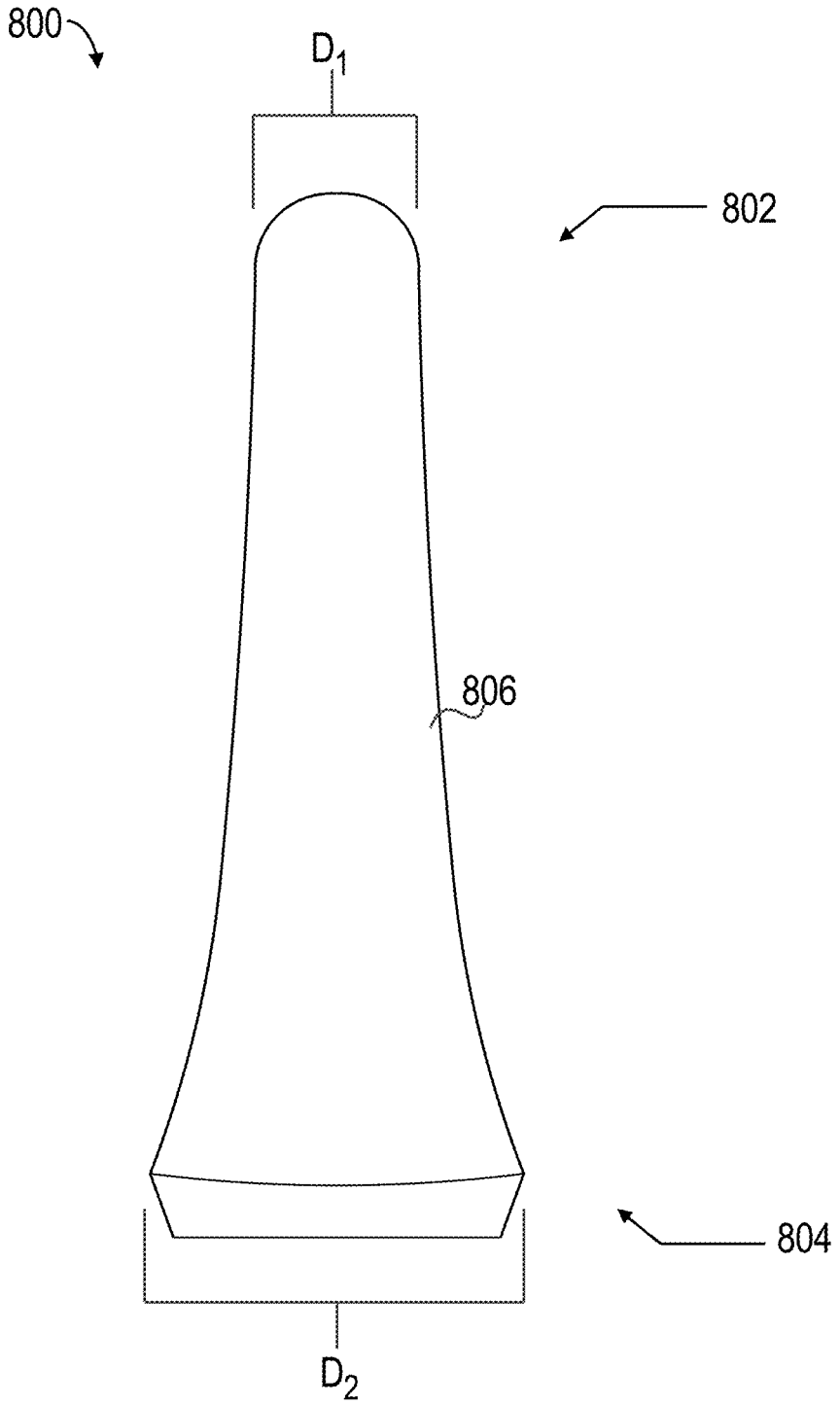
FIG. 8 illustrates a perspective view of a cap.

FIG. 8 illustrates a perspective view of a cap 800, in accordance with various embodiments. As shown in FIG. 8, the cap 800 (also referred to as a "cover") may include a flexible body that has a first end 802 (also referred to as the "distal end") and a second end 804 (also referred to as the "proximal end") opposing the first end 802. The distal end 802 may be closed and rounded so as to form a rounded cone, for example. The closed distal end 802 may prevent external objects (e.g., dirt, debris, and hair) from entering a cavity defined within the flexible body of the cap 800.

The shape of the cap 800 may form an elongated bell shape. In some embodiments, the distal end 802 has a diameter ($D_1$) that is smaller than the diameter ($D_2$) of the proximal end 804. In other embodiments, the diameter ($D_1$) of the distal end 802 is substantially similar to the diameter ($D_2$) of the proximal end 804. The proximal end 804 may have a diameter ($D_2$) of between 0.19-0.78 inches (0.5-2.0 centimeters (cm)). The proximal end 804 may include an opening that is representative of an ingress point into a cavity, which will be discussed in greater detail below.

As shown in FIG. 8, the flexible body has an external surface 806 that may come into contact with other items. The external surface 806 may be substantially cylindrical or conical in shape. The flexible body may be tapered such that the diameter ($D_1$) of the distal end 802 gradually increases to diameter ($D_2$) at proximal end 804. In some embodiments, the external surface 806 may be smooth or include a series of ridges that can be used to increase a grip on the cap 800.

Figure 9:
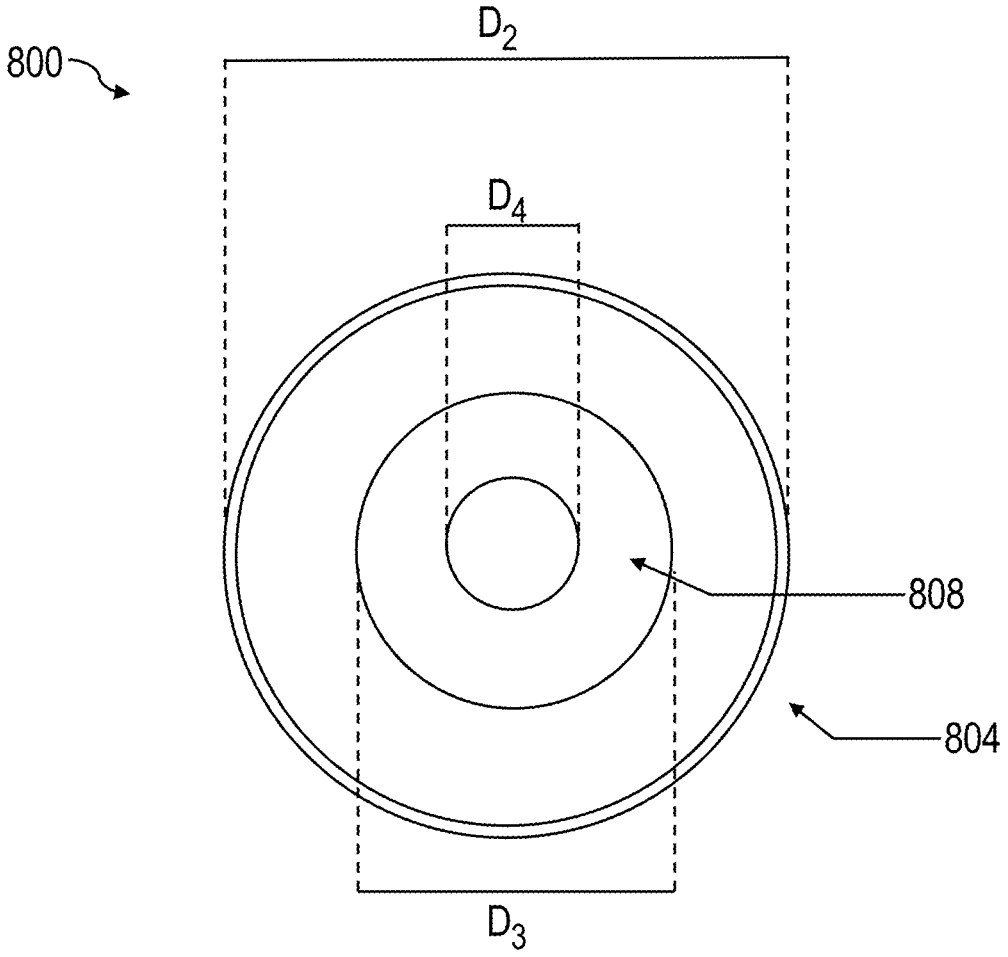
FIG. 9 illustrates a bottom view of the cap of FIG. 8.

FIG. 9 illustrates a bottom view of a cap 800, in accordance with various embodiments. As shown in FIG. 9, the proximal end 804 of the cap 800 may include an opening that exposes a cavity 808. Cavity 808 may allow for an interior surface of the cap 800 to fit around an application segment of an applicator, which is discussed in further detail below.

As discussed above, the proximal end 804 may have a diameter ($D_2$) while the distal end 802 may have an inner diameter ($D_4$). The interior surface that defines the cavity 808 may be tapered such that the diameter of the cavity 808 increases along the length defined from the distal end 802 to the proximal end 804. Accordingly, the diameter of the cavity 808 may be largest at the proximal end 802 in some embodiments. The diameter ($D_3$) of the cavity 808 may be less than the diameter ($D_2$) of the proximal end 804 but greater than the inner diameter ($D_4$) of the distal end 802.

Figure 10:
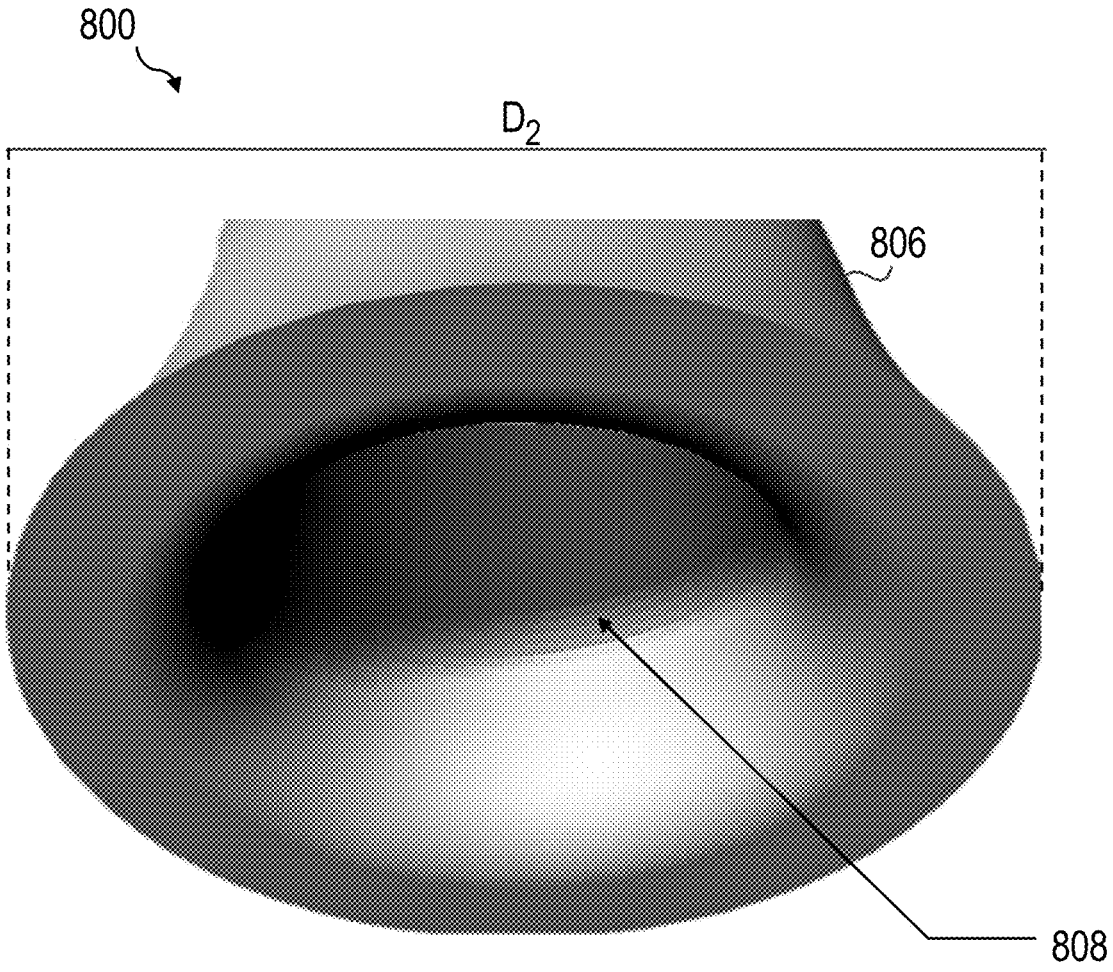
FIG. 10 illustrates a perspective view of a cavity that is formed in the cap of FIG. 8.

FIG. 10 illustrates a perspective view of a cavity 808 that is formed in a cap 800, in accordance with various embodiments. As shown in FIG. 10, the flexible body may form a lip that surrounds the opening to the cavity 808. In some embodiments, the opening is no more than 0.4 inches in diameter.

Generally, the cavity 808 has a length of no more than 1.5 inches (3.81 cm). However, the length of the cavity could vary from 0.5 inches (1.27 cm) to 3.0 inches (7.62 cm). Likewise, the diameter of the cavity 808 could vary. In some embodiments, the cavity 808 has a diameter of no more than 0.5 inches (1.27 cm).

Figure 11:
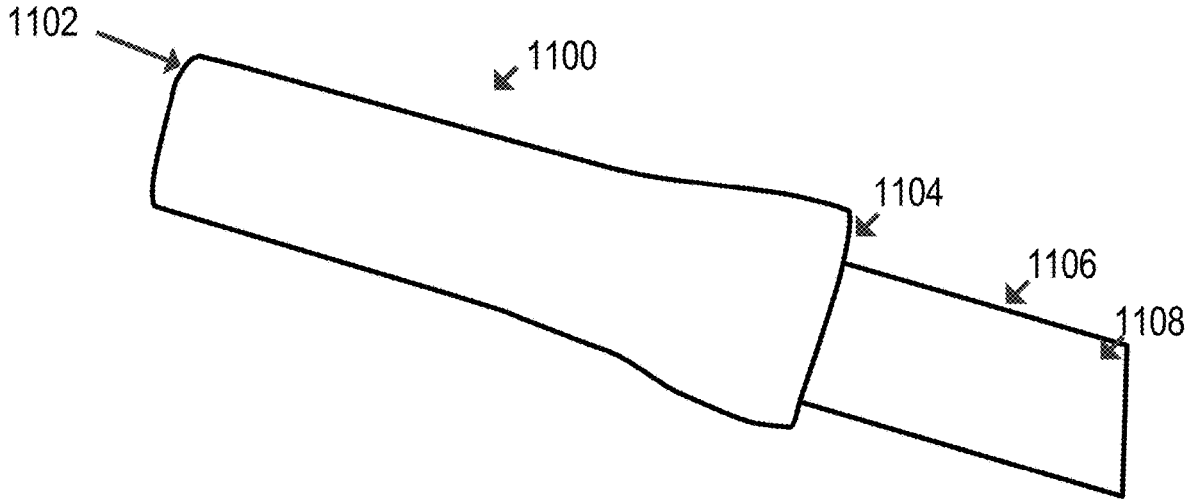
FIG. 11 illustrates a perspective view of a cap that has been removably engaged with an applicator.

FIG. 11 illustrates a perspective view of a cap 1100 that has been removably engaged with an applicator 1106, in accordance with various embodiments. As shown in FIG. 11, the cap 1100 may engage an applicator 1106 so that its application segment is secured within the cavity. As noted above, the applicator 1106 may be any implement that can apply a material (e.g., fluid, wax) onto a substrate (e.g., paper, skin). Example of applicators include cosmetic implements (e.g., lipstick, eyeliner, lip pencils, brushes, and sponges) and tattoo pens.

An application segment of an applicator 1106 can be disposed within the cavity defined in the flexible body of the cap 1100. For instance, an individual may insert the applicator through an opening along the proximal end 1104 of the cap so that the application segment extends toward the distal end 1102 of the cap 1100. The flexible body may surround the application segment and form a seal between the cap 1100 and applicator 1106. Particularly, the inner surface of the flexible body may apply pressure to the surface of the applicator 1106 to form the seal. When the application segment of the applicator is lodged in side the cap 1100, the handling segment 1108 may still be exposed. To remove the cap 1100 from the applicator 1106, an individual may simply grasp the handling segment 1108 and then tug on the distal end 1102 of the cap 1100.

Figure 12:
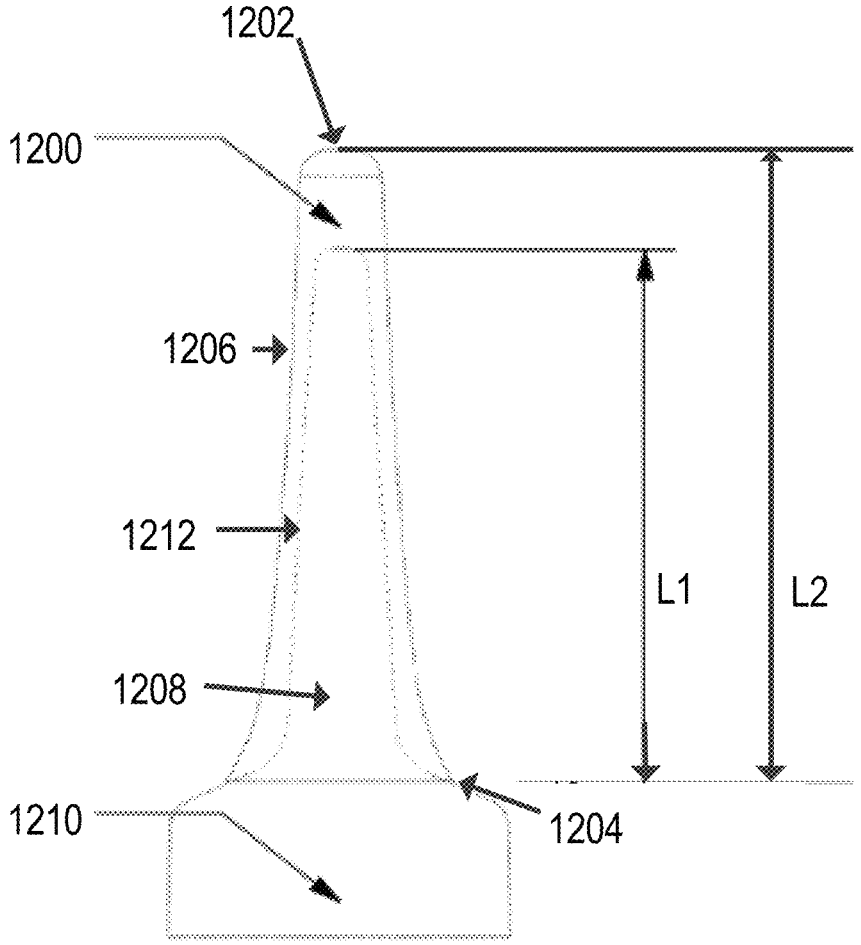
FIG. 12 illustrates a perspective view of a cap and a dowel.

FIG. 12 illustrates a perspective view of a cap 1200 and a dowel 1210, in accordance with various embodiments. The dowel 1210 may be disposed within the cap 1200 to form the cavity 1208. The dowel 1210 may be removed, exposing the cavity 1208 and interior surface 1212 of the tubular body 1206 that is representative of the structural body of the cap 1200. In some embodiments, the inner surface 1212 of the cap 1200 may define the cavity 1208 in the form of a cone.

In operation, to manufacture the cap 1200, a flexible material (e.g., silicone, elastic polymer) may be disposed around the dowel 1210. After the flexible material is disposed around the dowel 1210, the dowel 1210 may be removed from the cap 1200, exposing the cavity 1208.

As shown in FIG. 12, the cap 1200 may include an interior length (L1) representing the distance from the proximal end 1204 to the top of the cavity 1208. Additionally, the cap 1200 may include cap length (L2) representing the distance from distal end 1202 to proximal end 1204 of the cap 1200, where L2 is greater than L1. The cap length (L2) may range between 0.78-3.93 inches (2-10 cm), while the interior length (L1) may range between 0.3-2 inches (0.762-5.08 cm).

Figure 13B:
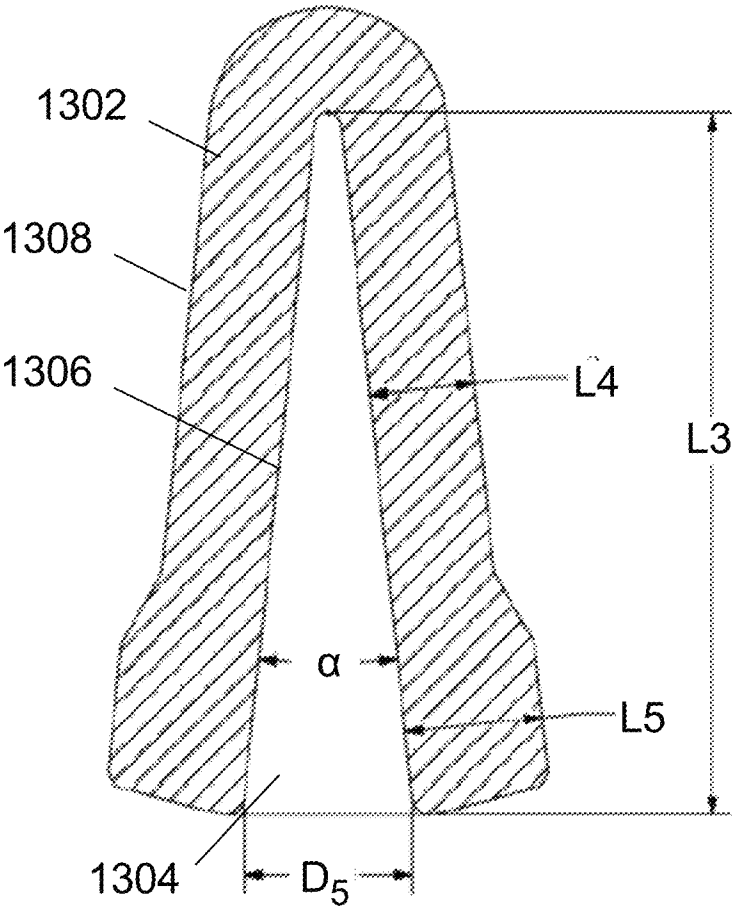
FIGS. 13A and 13B illustrate side and vertical cross-sectional views of an example cap taken along line 13B-13B of FIG. 13A.
Figure 13A:
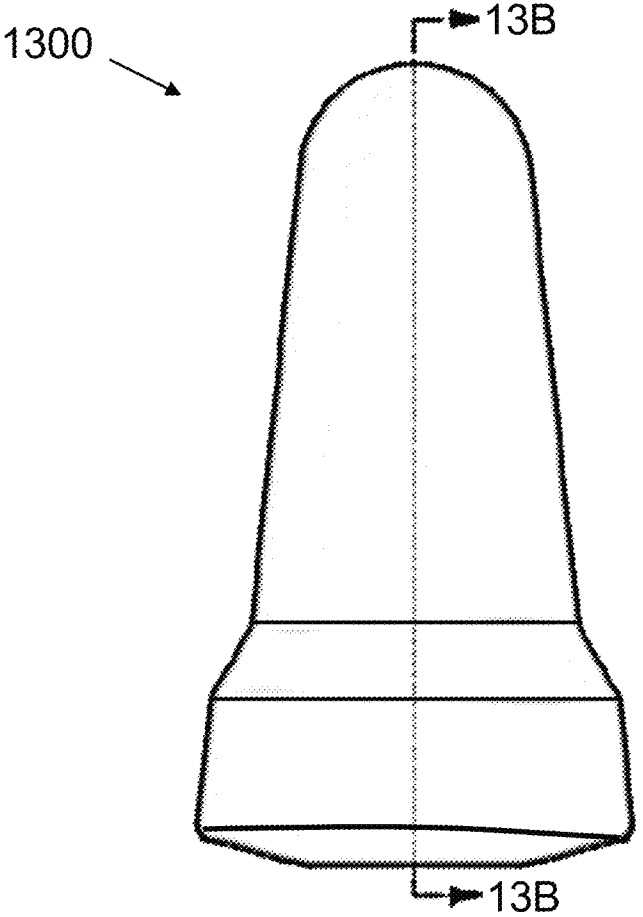

FIGS. 13A-B illustrate an example cap 1300. As shown in FIGS. 13A-B, the cap 1300 may include a toroidal proximal end with squared edges. The cap 1300 may include a flexible body 1302. The flexible body 1302 may be comprised of a deformable material, such as rubber, silicone, or another elastomer, similar to flexible body 104 in FIG. 1. When an applicator is inserted into the cavity 1304, the flexible body 1302 may deform in response to pressure from the inserted applicator. The deformable material may then exert opposing pressure when returning to its original shape, gripping the inserted applicator by elastic force. The tapering allows for applicators of various sizes to be lodged at corresponding depths into the cavity 1304.

In some embodiments, as shown in FIG. 13B, the cap 1300 includes a cavity 1304 defined by an interior surface 1306 of the flexible body 1302. The cavity 1304 may gradually taper from a proximal end a distal end. For example, the interior surface 1306 may taper such that the cavity 1304 has an angle $\alpha$ of approximately 12 degrees as shown in FIG. 13B, though the cavity 1304 may be wider or narrower in other embodiments. The cap 1300 may also include a distance between the interior surface 1306 and the exterior surface 1308 (also referred to as the "thickness" of the flexible body 1302). An example distance L4 between the interior surface 1306 and the exterior surface 1308 may be around 0.1875 inches (0.47 cm). Another example distance L5 between the interior surface 1306 and the exterior surface 1308 may be 0.25 inches. Further, an example length L3 of the cavity 1304 may be around 1.25 inches (3.175 cm). An inner diameter $D_5$ of the cavity 1304 may be 0.30 inches.

Figure 14B:
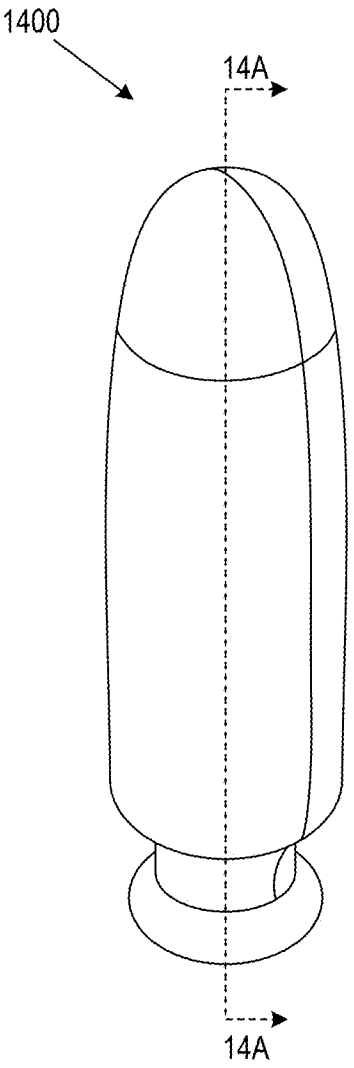
FIGS. 14A and 14B illustrate side and vertical cross-sectional views of an example cap taken along line 14B-14B of FIG. 14A.
Figure 14A:
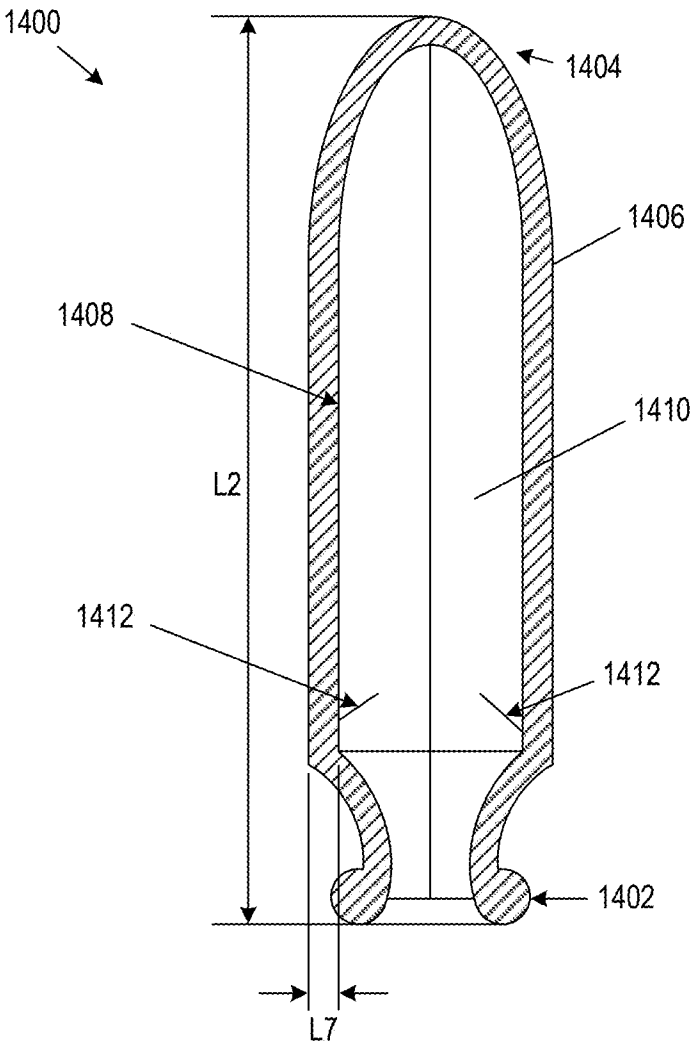

FIGS. 14A-B illustrate an example cap 1400. As shown in FIGS. 14A-B, the cap 1400 may be substantially bullet-shaped. In other words, the exterior surface 1406 of the cap may taper outward from the proximal end 1402, and then taper inwards near the distal end 1404. In some embodiments, the proximal end 1402 may comprise a torus. The toroidal shape may facilitate the seal formed between the cavity 1410 and an applicator. Generally, the tubular body of the cap has a thickness of 1.0-5.0 mm (and preferably 1.0-2.0 mm) to allow for deformation while still providing sufficient rigidity. In the embodiment shown in FIGS. 14A-B, for example, the tubular body has a thickness L7 of approximately 1.5 mm.

In some embodiments, as shown in FIG. 14A, the cap 1400 may include a corrugation 1412. The corrugation 1412 may include a flange or fin defined along the inner surface 1408 that defines the cavity 1410 of the cap 1400. In operation, the corrugation 1412 may prevent backflow of any fluid discharged by the applicator through the opening along the proximal end 1402. Moreover, the corrugation 1412 may inhibit the flow of fluid (e.g., water or air) into the cavity 1410 through the opening along the proximal end 1402.

Figure 15C:
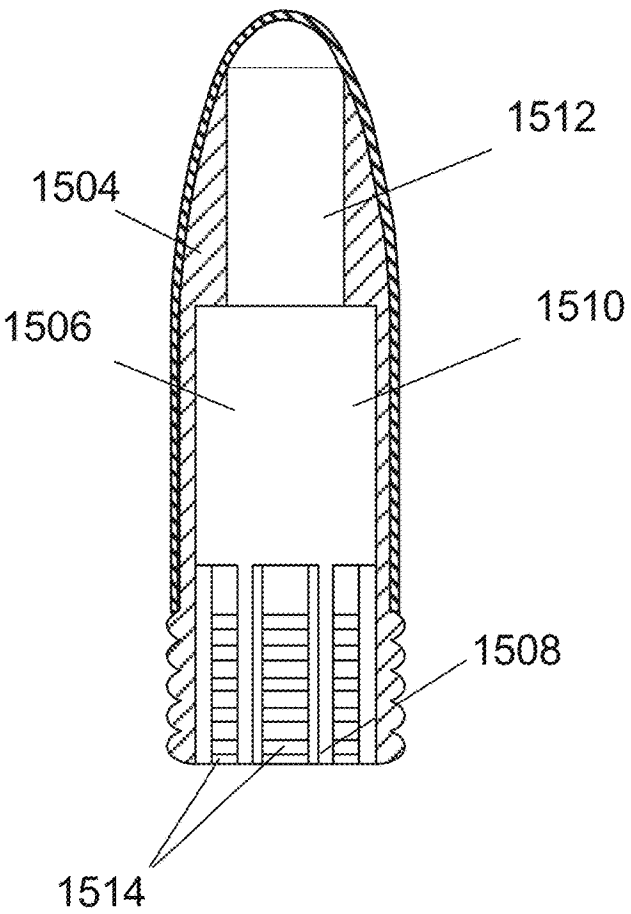
FIGS. 15A, 15B, and 15C illustrate side, bottom and vertical cross-sectional views of an example cap taken along line 15C-15C of FIG. 15A.
Figure 15B:
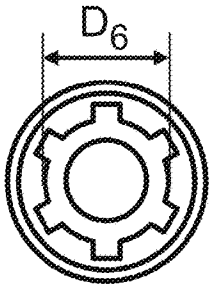
Figure 15A:
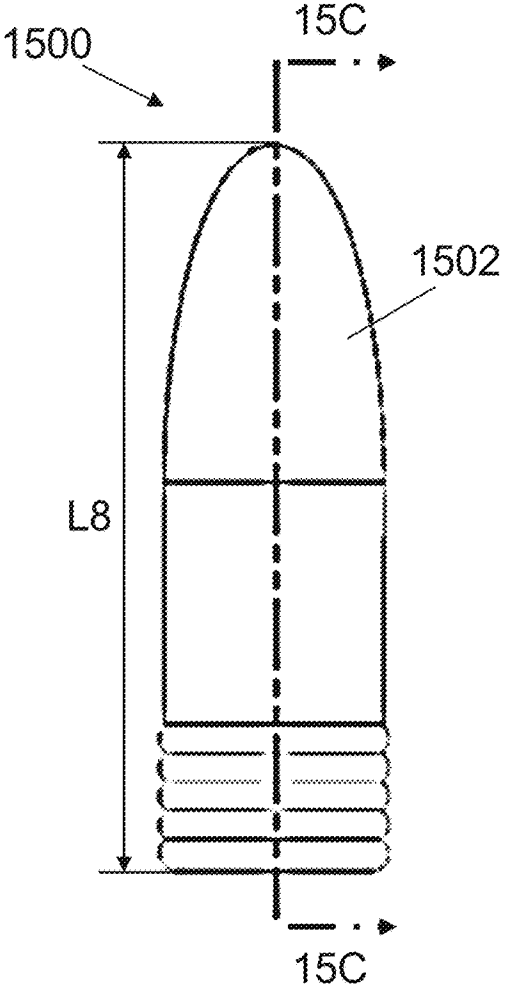

FIGS. 15A-C illustrate side, bottom and vertical cross sectional views of an example cap 1500. Cap 1500 includes a rigid housing 1502 and a flexible body 1504. Cap 1500 can be similar to cap 100 in FIGS. 1-3, cap 400 in FIGS. 4-6, or caps 700*a-c* in FIG. 7. In some embodiments, the flexible body 1504 can be comprised of a single piece of flexible material. In some embodiments, the flexible body 1504 can be comprised of two or more pieces, similar to the first and second inserts 404 and 406 in FIG. 4.

The inner surface of the flexible body 1504 can define a cavity 1506. The cavity 1506 may be comprised of a proximal portion 1508, a medial portion 1510, and a distal portion 1512, as shown in FIG. 15C. The proximal portion 1508 may include a plurality of protrusions 1514 which are configured to apply pressure to a handle segment of a cosmetic implement inserted into the cavity 1506. The distal portion 1512 may store an application segment of a first applicator and have a third inner diameter less than the first inner diameter of the proximal portion 1508. The medial portion 1510 may store an application segment of a second applicator and have a second inner diameter greater than the diameter of the proximal portion 1508. For example, the first applicator may be a pencil tip and the second applicator may be a brush or lipstick.

As shown in FIG. 15A, the cap 1500 has a length L8 of approximately 2.0 inches and a diameter of approximately 0.5 inches. As shown in FIGS. 15B-C, the proximal portion 1508 of the cap 1500 may have a gear-shaped opening defined by the protrusions 1514 through which an application segment of an applicator can be inserted. The gear-shaped opening may have a diameter De of approximately 0.40 inches. As the application segment travels toward the proximal end of the cap 1500 in the cavity, the diameter may change, as described above.

Figure 16:
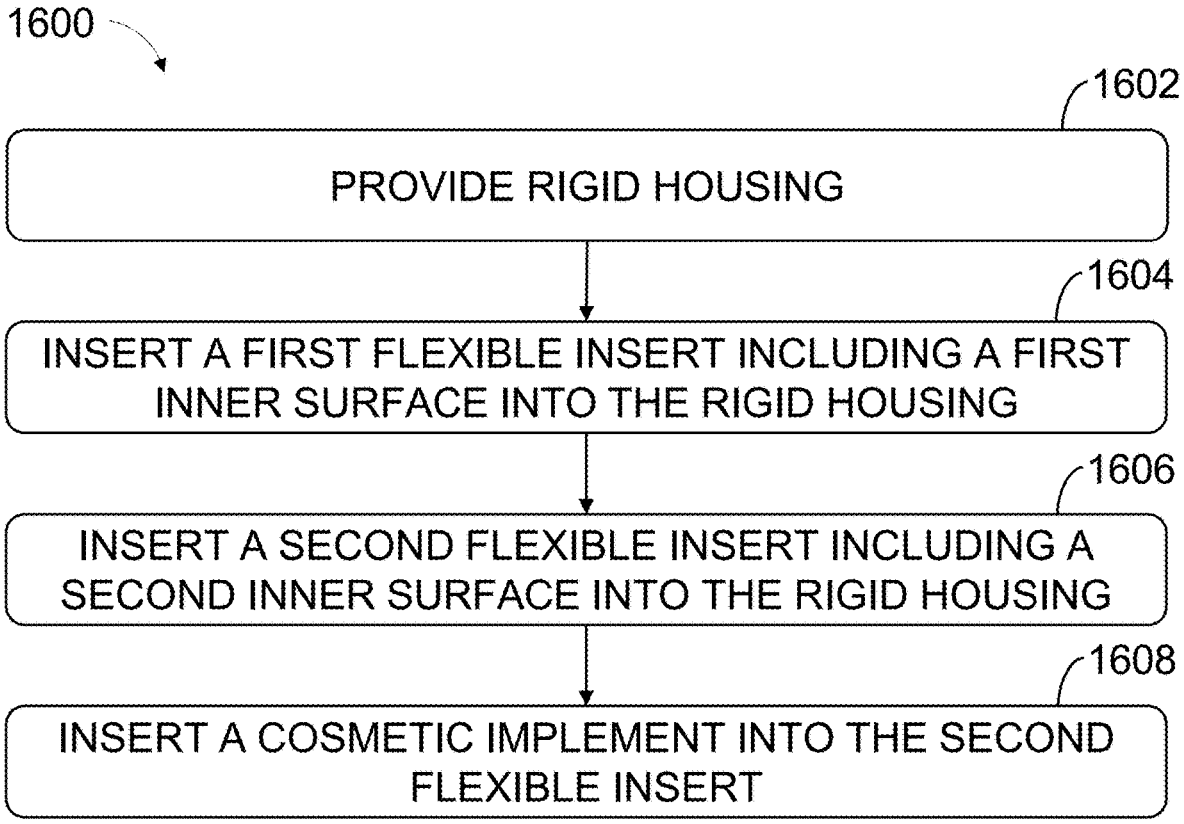
FIG. 16 illustrates an example method for assembling a cap for cosmetic implements, in accordance with various embodiments.

FIG. 16 illustrates an example method 1600 for assembling a cap for cosmetic implements, in accordance with various embodiments. Method 1600 may also be used to engage an applicator to a cap for cosmetic implements. At block 1602, a rigid housing is provided. The rigid housing may be similar to rigid housing 102, 402, 702, or 1502 described above. The rigid housing may include a proximal opening.

At block 1604, a first flexible insert including a first inner surface is inserted into the rigid housing. The first flexible insert may be inserted entirely within the rigid housing. The first flexible insert may be similar to the first flexible insert 404 in FIG. 4. The first flexible insert may be inserted into the rigid housing through a proximal opening of the rigid housing. The first inner surface may define a cavity in which an application segment of a cosmetic implement may be stored.

At block 1606, a second flexible insert including a second inner surface is inserted into the rigid housing. The second flexible insert may be inserted substantially within the rigid housing. The second flexible insert may be similar to the second flexible insert 406 in FIG. 4. The second flexible insert may be inserted into the rigid housing through a proximal opening of the rigid housing. The second flexible insert may be flush with the first flexible insert from block 1604. The second inner surface may define a channel in which an application segment of a cosmetic implement may be stored. When the second flexible insert is inserted into the rigid housing, this channel may be contiguous with the cavity defined by the inner surface of the first flexible insert. The second inner surface may include a plurality of protrusions which grip a handle segment of a cosmetic implement. The second At block 1608, a cosmetic implement is inserted into the second flexible insert. The cosmetic implement may be inserted so an application segment is enclosed by the rigid housing while a handle segment is partially enclosed. Depending on the type, shape, or size of the application segment, the application segment may be stored in the cavity formed by the first flexible insert, in the channel formed by the second flexible insert, or both. When inserted, the inner surface of the second flexible insert may apply pressure to a surface of the handle segment to form a seal.

In some embodiments, the method may include preventing, by a corrugation defined along the inner surface that defines the cavity, backflow of any fluid discharged by the applicator toward the opening.

A method of producing a cap as described herein may include a production process. The production process may include applying a flexible material (e.g., silicon, elastic polymer) around a mold, where the mold forms a cavity. The production process may include removing the mold to expose an opening and the cavity. The production process may include injection molding, extrusion, three-dimension (3D) printing, or other methods of forming an elastic material into a desired shape.

REMARKS

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling those skilled in the relevant art to understand the claimed subject matter, the various embodiments, and the various modifications that are suited to the particular uses contemplated.

Although the Detailed Description describes certain embodiments and the best mode contemplated, the technology can be practiced in many ways no matter how detailed the Detailed Description appears. Embodiments may vary considerably in their implementation details, while still being encompassed by the specification. Particular terminology used when describing certain features or aspects of various embodiments should not be taken to imply that the terminology is being redefined herein to be restricted to any specific characteristics, features, or aspects of the technology with which that terminology is associated. In general, the terms used in the following claims should not be construed to limit the technology to the specific embodiments disclosed in the specification, unless those terms are explicitly defined herein. Accordingly, the actual scope of the technology encompasses not only the disclosed embodiments, but also all equivalent ways of practicing or implementing the embodiments.

The language used in the specification has been principally selected for readability and instructional purposes. It may not have been selected to delineate or circumscribe the subject matter. It is therefore intended that the scope of the technology be limited not by this Detailed Description, but rather by any claims that issue on an application based hereon. Accordingly, the disclosure of various embodiments is intended to be illustrative, but not limiting, of the scope of the technology as set forth in the following claims.

What is claimed is:

1. An apparatus that is able to enclose application segments of cosmetic implements of different thicknesses, one at a time, the apparatus comprising:

an exterior housing comprising a closed distal end portion and a proximal end portion including a housing opening; and a tubular body formed of a deformable material that is positioned partially within the housing opening, wherein the tubular body includes:

a proximal portion that has a proximal opening through which the application segments of the cosmetic implements are insertable, wherein the proximal portion is positioned outside of the exterior housing, a distal portion that has a cavity in which the application segments of the cosmetic implements are storable, wherein the distal portion is in contact with the closed distal end portion of the exterior housing, a medial portion that is interconnected between the proximal and distal portions, a channel defined by an inner surface of the tubular body that extends through the proximal, medial, and distal portions, wherein the channel has:

a first inner diameter within the proximal portion of the tubular body, a second inner diameter that is greater than the first inner diameter within the medial portion of the tubular body, and a third inner diameter that is less than the second inner diameter within the distal portion of the tubular body, wherein the second inner diameter is constant throughout the medial portion of the tubular body, and a plurality of protrusions located along the channel in the proximal portion, wherein when the application segments of the cosmetic implements are located in the cavity in the distal portion, the plurality of protrusions are configured to deform outwardly and apply pressure to the cosmetic implements to grip the cosmetic implements and inhibit movement of the cosmetic implements.

2. The apparatus of claim 1, wherein the distal portion comprises a first piece of deformable material, and the proximal portion comprises a second piece of deformable material.

3. The apparatus of claim 1, wherein the tubular body comprises a single piece of deformable material.

4. The apparatus of claim 1, wherein the tubular body is removable from the exterior housing.

5. The apparatus of claim 1, wherein the deformable material is an elastomer.

6. The apparatus of claim 1, wherein the distal portion of the tubular body includes a distal opening, and wherein the channel extends fully through the tubular body from the proximal opening to the distal opening.

7. The apparatus of claim 1, wherein the tubular body further includes an outer surface, and wherein the outer surface along the distal portion is a rounded cone.

8. The apparatus of claim 1, wherein the third inner diameter within the distal portion of the tubular body is less than the first inner diameter of the proximal portion of the tubular body.

9. The apparatus of claim 1, wherein a length of the apparatus is approximately 2.0 inches, and wherein a diameter of the apparatus is approximately 0.5 inches.

10. The apparatus of claim 1, wherein the plurality of protrusions are circumferentially spaced apart from one another to form a gear-shape.

11. The apparatus of claim 1, wherein an external surface of the proximal portion of the tubular body comprises a series of ridges.

12. The apparatus of claim 1, wherein the closed distal end portion is rounded.

* * * * *